US006610214B2

(12) United States Patent
Goldenhersh et al.

(10) Patent No.: US 6,610,214 B2
(45) Date of Patent: Aug. 26, 2003

(54) UVR ATTENUATION OF FABRICS AND FINISHED TEXTILES

(75) Inventors: Michael A. Goldenhersh, Jerusalem (IL); Itzhak Shalev, Bet Gamliel (IL)

(73) Assignee: Goldenguard Technologies Ltd., Jerusalem (IL)

( * ) Notice: Subject to any disclaimer, the term of this patent is extended or adjusted under 35 U.S.C. 154(b) by 0 days.

(21) Appl. No.: 09/908,840

(22) Filed: Jul. 20, 2001

(65) Prior Publication Data

US 2003/0015684 A1 Jan. 23, 2003

(51) Int. Cl.[7] ..... D06M 11/00; D06M 15/00

(52) U.S. Cl. ..... 252/8.61; 252/8.81; 252/8.91; 252/588; 427/389.9; 442/131; 442/132; 442/133

(58) Field of Search ..... 252/8.61, 8.81, 252/8.91, 588; 427/389.9; 442/131, 132, 133

(56) References Cited

U.S. PATENT DOCUMENTS 3,650,799 A * 3/1972 Young et al. ..... 428/336
5,352,725 A * 10/1994 Palmer et al. ..... 252/507
5,503,917 A * 4/1996 Hughes ..... 428/85
5,637,348 A * 6/1997 Thompson et al. ..... 427/160
5,973,023 A * 10/1999 Altes et al. ..... 523/122
6,114,427 A * 9/2000 Gard ..... 524/413

FOREIGN PATENT DOCUMENTS

JP 3-134069 * 6/1991
JP 3-143965 * 6/1991
WO WO 01/86054 A1 * 11/2001

* cited by examiner

*Primary Examiner*—Anthony J. Green
(74) *Attorney, Agent, or Firm*—Mark M. Friedman

(57) ABSTRACT

Materials for, and methods of protecting yarns, fibers, fabrics and finished textiles from the deleterious effects of ultraviolet radiation. The materials include at least one physical UVR attenuator, having an average particle size below 1000 nanometers, and at least one flexible, film-forming polymeric binder for bonding the material to a fabric surface, wherein the physical UVR attenuator is dispersed within said binder to form an aqueous dispersion. Also disclosed are materials including both physical and chemical UVR attenuators, in which a synergistic protection effect is achieved.

39 Claims, 3 Drawing Sheets

FIGURE 1: UV Transmission of Fabric with and without UV Blocker in the Resin
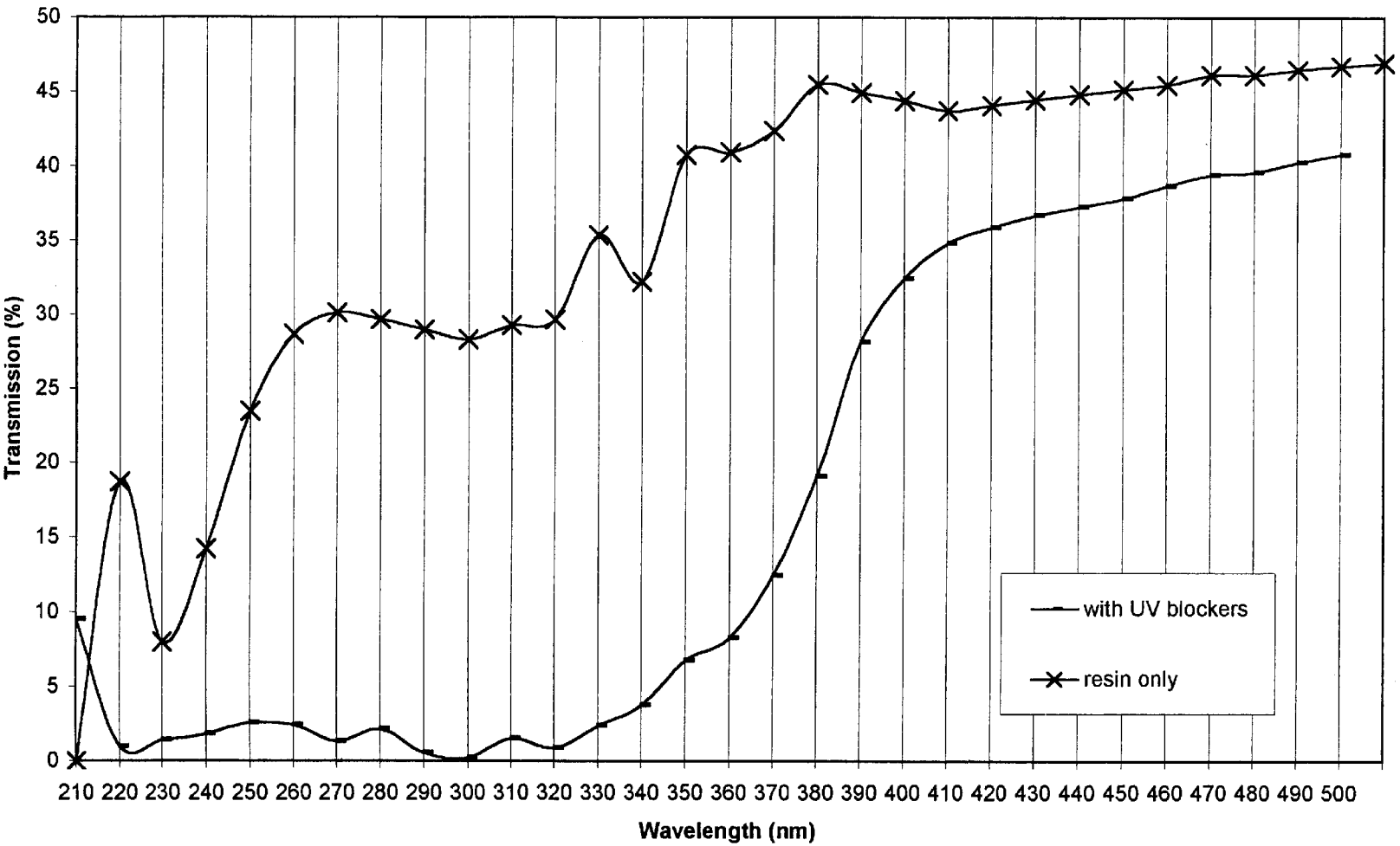

FIGURE 2: UV Transmission Using Various Chemical & Physical Blockers on Fabric
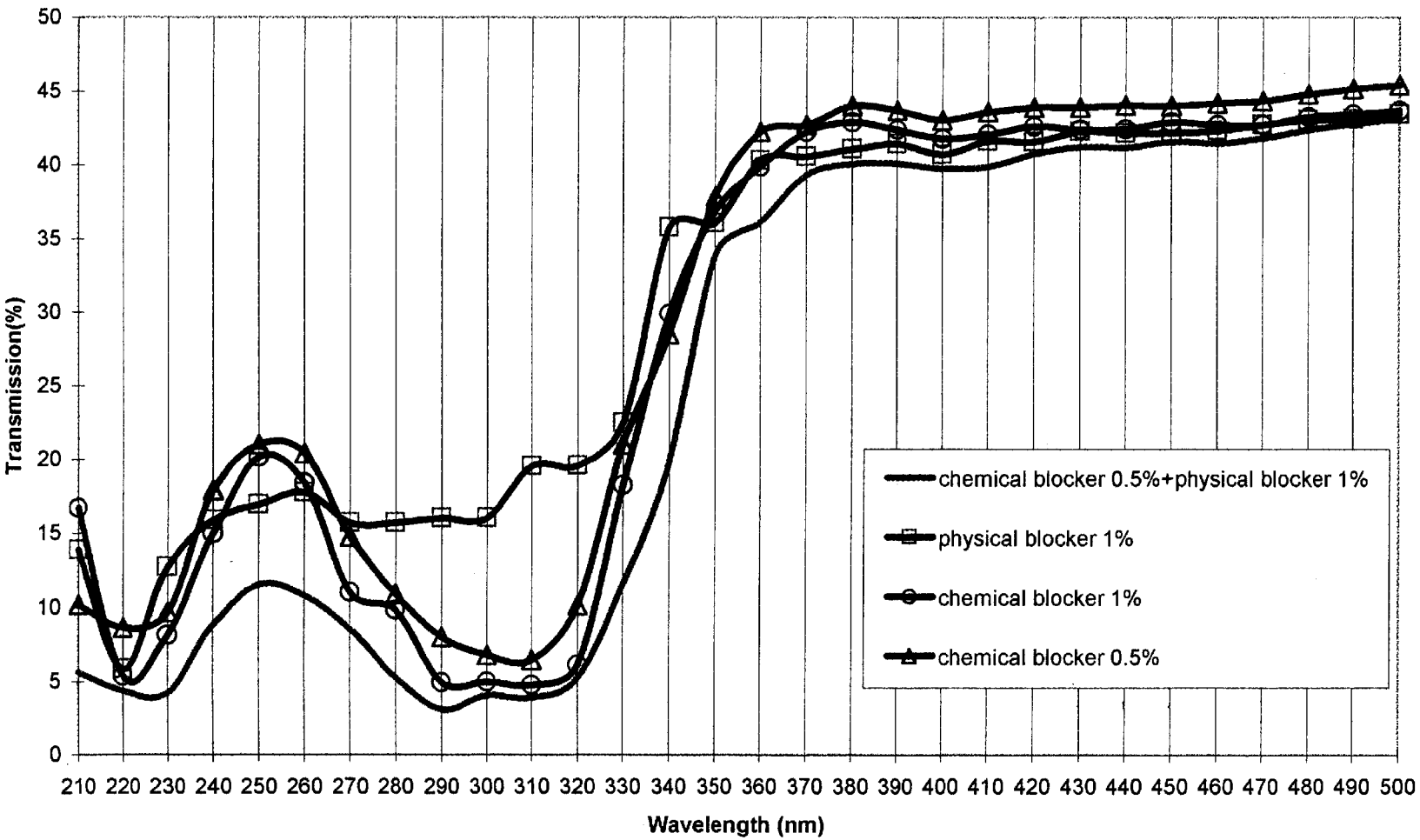

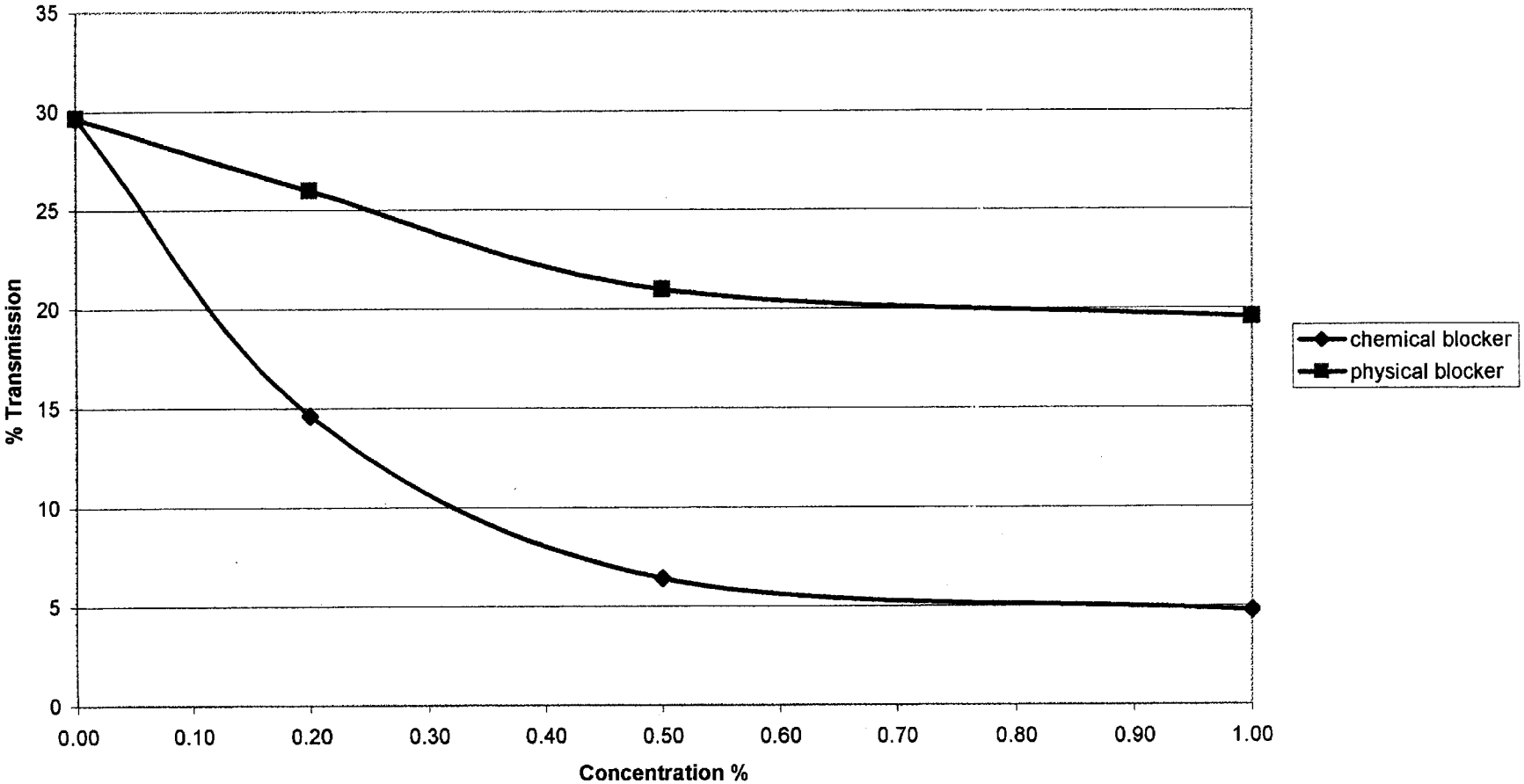
FIGURE 3: UV Transmission @ 310nm VS the Concentration of Chemical & Physical Attenuators in the Resin

UVR ATTENUATION OF FABRICS AND FINISHED TEXTILES

FIELD AND BACKGROUND OF THE INVENTION

The present invention relates to formulations for, and methods of, protecting fibers, fabrics and finished textiles and the like from fading and discoloration, degradation, deterioration, disintegration and other deleterious effects of ultraviolet radiation.

It is known that ultraviolet radiation (UVR) has many harmful effects on humans, causing, for instance, prematurely wrinkled skin, skin cancer, and cataracts. UVR, which has been proven to be harmful to human skin, includes two different radiation ranges usually known as UV-A (having a wavelength of about 320 to 400 nm) and UV-B (having a wavelength of about 290 to 320 nm). Therefore, it is desired and necessary to reduce or prevent the transmission of UVR to human skin by blocking or absorbing such radiation between 290 to 400 nm.

Partial human skin protection can be achieved by using sun protective compositions developed for direct contact with the skin. Many of them contain relatively effective UVR blocking or absorbing compounds, such as para-amino benzoic acid, also known to those skilled in the art as PABA. However, direct contact compositions have not proven to be entirely satisfactory in use. They are typically inconvenient to apply, costly, require frequent re-application and may cause allergic contact dermatitis or other skin irritations. In addition, in some extreme climatic or weather conditions, such as arid or high temperature zones, high mountainous areas and close to sea beaches where the UVR is high, the only practical way of protecting human skin from the UVR deleterious effects is by covering the body with clothes.

Clothing made of untreated yarn may block the transmission of UVR but, when a fabric has only loosely intermeshed fibers, or when the interstices defined by the thread of woven fabric are large, UVR that might otherwise be stopped by the fibers can pass through the apertures and reach the wearer skin unless the fabric is layered. Obviously such clothing is sometimes heavy and incompatible with warm weather, precisely when protection from UVR is needed. Indeed, in such circumstances, UV chemical blockers have been incorporated into fabrics to provide the necessary protection by physically blocking by filling or covering the apertures by UV chemical attenuators.

U.S. Pat. No. 4,857,305 to Bernhardt et al., U.S. Pat. No. 5,458,924 to Kashiwai et al., and U.S. Pat. No. 5,637,368 to Thompson et al., as well as U.K. Patent No. 889292 to American Cyanamid represent this technology of providing chemical compounds into or onto fabrics to attenuate the ultraviolet radiation. U.S. Pat. No. 4,861,651 to Goldenhersh discloses a coating for applying to the fabric. U.S. Pat. No. 6,194,330B1 to Vogt et al. teaches the application of a latex such that at least part of the coating or latex is disposed in the interstices of the fabric, thus blocking the free passage of UVR to the wearer.

Coating compositions usually contain polymeric binders, an effective amount of an UVR attenuator and surfactants and thickeners.

Many compounds are used in prior art as polymeric binders: polyurethanes, acrylics and silicon compounds, as well as fluorochemical resins and many other similar compounds. U.S. Pat. No. 5,374,362 to McFarland, for instance, teaches the use of fluorochemical, silicon and acrylic compounds, while U.S. Pat. No. 5,143,729 to Thompson uses polystyrene methyl metacrylate and U.S. Pat. No. 6,194,330B1 to Vogt et al. uses acrylates and metacrylates.

UVR attenuators, also known as UVR blockers, include compounds that absorb, block, reflect or otherwise attenuate the ultraviolet radiation, such as para-amino benzoic acid (PABA), which is a very popular compound in the art, benzotriazoles and benzophenones that are used, for instance, in U.S. Pat. No. 3,888,821 and in many others.

A recent and sophisticated technology for producing transparent, ultra-fine particles of titanium dioxide and zinc oxide (having a diameter of 250 nm or less) allows the inclusion of such particles in conventional sunscreen products. The use of ultra-fine zinc oxide in the protection of human skin is discussed in: Mitchnick et al., "Microfine zinc oxide (Z-cote) as a photostable UVA/UVB sunblock agent", Journal of the American Academy of Dermatology, January 1999, Vol. 40, No. 1. The article describes the existence of a synergistic effect between a physical UVR attenuator (ultrafine zinc oxide) and a chemical UVR attenuator (octyl methoxycinnamate) measured by the sun protection factor (SPF).

There is no proven technology in the prior art that combines methods of, and materials for, protecting fabrics and finished textiles and the like, from fading and discoloration, degradation, deterioration, disintegration and other deleterious effects of ultraviolet radiation, which include both chemical and physical UVR attenuators. More particularly, there are no methods of, and materials in prior art for, protecting fabrics and finished textiles, and the like, from deleterious effects of ultraviolet radiation that have a synergistic effect of both the chemical and the physical UVR attenuators, and that are universally suitable for virtually almost all the fibers and fabrics used in the textile industry.

There is therefore a recognized need for, and it would be highly advantageous to have materials for, and methods of, protecting fabrics and finished textiles from the deleterious effects of UVR in a more simple and inexpensive way than is heretofore known.

SUMMARY OF THE INVENTION

The present invention is a system of formulations for, and methods of, protecting fabrics and finished textiles from UVR. It has been found that physical UVR attenuators provide protection from UVR to fabrics and finished textiles. In addition, the combination of chemical and physical UVR attenuators has been found to provide a surprising synergistic effect in the protection of fabrics and textiles. Moreover, the chemical and physical UVR attenuators are combined to form a stable and rugged coating that strongly bonds to fabric. The coating withstands extreme climactic conditions and repeated washings, and does not peel, crack, crumble or wear in the rigors of day to day use.

It has also been found that a single formulation can be applied as a thin layer to fabrics of widely differing character and composition, such as natural and synthetic fabrics and combinations thereof.

According to the teachings of the present invention there is provided, a material for protecting yarns, fibers, fabrics and finished textiles from the deleterious effects of ultraviolet radiation including: (a) at least one physical UVR attenuator, the attenuator having an average particle size below 1000 nanometers, and (b) at least one flexible, film-forming polymeric binder for bonding the material to a fabric surface, wherein the physical UVR attenuator is dispersed within the binder to form an aqueous dispersion.

According to another aspect of the present invention there is provided a treated fabric structure including: (a) a material, the material formerly mentioned, and (b) a fabric having a plurality of surfaces, the material being intimately attached to at least a portion of the surfaces.

According to yet another aspect of the present invention there is provided a method for protecting yarns, fibers, fabrics and finished textiles from the deleterious effects of ultraviolet radiation, the method including the steps of: (a) providing a formulation including: (i) at least one physical UVR attenuator, the attenuator having an average particle size below 1000 nanometers, and (ii) at least one flexible, film-forming polymeric binder; (b) applying the formulation to a fabric surface to produce a layer, and (c) intimately attaching the layer to the fabric surface.

According to one feature of the present invention, described in the preferred embodiments, the physical UVR attenuator has a concentration of between 1% and 20% on a weight basis.

According to another feature of the present invention, described in the preferred embodiments, the physical UVR attenuator has a particle size distribution wherein at least 80% of the particles have a long dimension below 1000 nanometers.

According to yet another feature of the present invention, described in the preferred embodiments, the physical UVR attenuator includes titanium dioxide.

According to still another feature of the present invention, described in the preferred embodiments, the physical UVR attenuator includes zinc oxide.

According to still another feature of the present invention, the physical UVR attenuator includes teflon.

According to still another feature, described in the preferred embodiments, the dispersion is a substantially fully dispersed dispersion.

According to a further feature, described in the preferred embodiments, the at least one flexible, film-forming polymeric binder includes acrylic resin.

According to another further feature of the invention, described in the preferred embodiments, the at least one flexible, film-forming polymeric binder includes polyurethane.

According to yet a further feature of the invention, described in the preferred embodiments, the material further includes at least one chemical UVR attenuator.

According to still a further feature of the invention, described in the preferred embodiments, the chemical UVR attenuator is dispersed within the binder to form a phase selected from the group consisting of aqueous dispersion and solution, the chemical UVR attenuator having a concentration of between 0.2% and 5% on a weight basis.

According to still a further feature of the invention, described in the preferred embodiments, the chemical UVR attenuator is selected from the group consisting of p-amino benzoic acid (PABA) and esters thereof, benzophenones, benzo-triazoles, cinnamates, avobenzones, oxybenzones and similar functional compounds.

According to still another further feature of the invention, described in the preferred embodiments, the material is designed and configured as a flexible layer for intimate attachment to a surface of the fabric, yarn or fiber.

According to still a further feature, described in the preferred embodiments, the layer is translucent.

According to still another further feature of the invention, described in the preferred embodiments, the layer is transparent.

According to still a further feature of the invention, described in the preferred embodiments, the layer has an average thickness of less than 100 micrometers.

According to still a further feature of the invention, described in the preferred embodiments, the layer has an average thickness of more than 100 nm.

According to still a further feature described in the preferred embodiments, the at least one binder is selected from the group consisting of butyl acrylate, ethyl acrylate, 2-ethyl hexylacrylate and methacrylate homologues, styrene, acrylonitrile, vinyl toluene and 1-methyl toluene.

According to still a further feature of the invention, described in the preferred embodiments, the material further includes at least one cross-linking material selected from the group consisting of allyl-methacrylate, methylolacrylamide and methylolmethacrylamide.

According to still a further feature of the invention, described in the preferred embodiments, the material incorporated in a treated fabric structure further including a fabric having a plurality of surfaces, the material being intimately attached to at least a portion of the surfaces.

According to still a further feature of the invention, described in the preferred embodiments, the material is disposed as a layer on the portion of the surfaces According to still a further feature of the invention, described in the preferred embodiments, the fabric surface includes both natural and synthetic materials.

According to still a further feature of the invention, the layer is a flexible, attrition-resistant layer having an average thickness of no more than 500 micrometers.

According to still a further feature of the invention, described in the preferred embodiments, the step of intimately attaching includes polymerization and curing.

According to still a further feature of the invention, the polymerization and the curing are performed at a temperature below 180° C.

According to still a further feature of the invention, the polymerization and the curing are performed at an ambient temperature.

According to still a further feature of the invention, described in the preferred embodiments, the applying is spraying.

According to still a further feature of the invention, described in the preferred embodiments, the applying is laminating.

According to still a further feature of the invention, described in the preferred embodiments, the spraying is an aerosol spraying performed at an ambient temperature.

The present invention successfully addresses the shortcomings of the existing technologies by providing a materials for and method of protecting fabrics and finished textiles from UVR by physical UVR attenuators applied to yarns, fibers, fabrics and finished textiles. In addition, the combination of chemical and physical UVR attenuators has been found to synergistically attenuate UVR. The coating withstands extreme climactic conditions and repeated washings, and does not peel, crack, crumble or wear in the rigors of day to day use. Moreover, a single formulation can be applied as a thin layer to fabrics of widely differing character and composition, such as natural and synthetic fabrics and combinations thereof. The present invention is simple to use, reliable, inexpensive and provides long lasting protection against UV radiation.

BRIEF DESCRIPTION OF THE DRAWINGS

FIG. 1 shows the UV transmission of fabric with and without UV attenuators in the resin;

FIG. 2 demonstrates the UV transmission of the combination of chemical and physical UV attenuators on fabric; and FIG. 3 shows the UV transmission at 310 nm vs. the concentration of chemical and physical UV attenuators in the resin.

DESCRIPTION OF THE PREFERRED EMBODIMENTS

The present invention teaches methods of, and materials for, protecting fabrics, finished textiles, and the like, from fading and discoloration, degradation, deterioration, disintegration and other deleterious effects of ultraviolet radiation. The materials preferably include both chemical and physical UVR attenuators.

More particularly, the present invention teaches methods of, and materials for, protecting fabrics from the deleterious effects of ultraviolet radiation by synergistically combining chemical and physical UVR attenuators. Moreover, formulations described hereinbelow have been found to be universally suitable for virtually all fibers and fabric used in the textile industry.

The principles and operation of the materials and methods according to the present invention may be better understood with reference to the accompanying drawings and description.

Before explaining at least one embodiment of the invention in detail, it is to be understood that the invention is not limited in its application to the details of the following drawings and description. The invention is capable of other embodiments or of being practiced or carried out in various ways. Also, it is to be understood that the phraseology and terminology employed herein is for the purpose of drawings and description, and should not be regarded as limiting.

As used herein in the specification and in the claims section that follows, the term "UVR" refers to ultraviolet radiation.

Referring now to the current invention, it is known that various finishing materials are available for protecting many types of yarns and fibers from UVR deleterious effects such as fading and discoloration, degradation, deterioration and disintegration. FIG. 1 is a typical example of the measured UV transmission of fabric with and without UV attenuator in the resin. It is obvious from the figure that treated fabric transmits less radiation than untreated fabric over the entire UVR range, such that the fabric is protected from the deleterious effects of the UVR.

Normally, yarns, fibers and fabrics are protected by applying various chemical UVR attenuators. According to some embodiments of the present invention, yarns, fibers and fabrics are protected from the deleterious effects of UV radiation by using only physical UVR attenuators such as zinc oxide, titanium dioxide, and teflon.

According to the known art, each type of yarn or fibers (cotton, linen, polyester, polyamide, viscose, etc.) requires chemical adaptation of a specific UVR attenuator and mode of application. Some embodiments of the present invention, however, enable universal application, such that a single chemical formulation can be applied to substantially any fabric type, thereby obviating the need for a selective UVR attenuator and application method. Moreover, since the layer applied is extremely thin, the UVR protective coating of the present invention can be applied without significant changes to the color, feel, and breathability of the treated yarn, fibers or fabric.

The chemical formulations used in the invention include one or more UVR attenuating chemicals in a polymeric binding system such as acrylic or methacrylic materials or polyurethane, especially formulated with cross-linking materials to facilitate fast drying in a wide range of temperatures without necessarily use of an oven. Other ingredients necessary in the formulation are softeners, surfactants, rheology modifiers and antifoams, as well as solvents, all of them generally commercially available products.

As already mentioned above, acrylic materials are used as binders for coating yarn, fibers or fabric. These contain at least one of the following monomer units in random repetitions: butyl acrylate, ethyl acrylate, 2-ethyl hexylacrylate and their methacrylate homologues. In addition, monomers such as styrene, acrylonitrile, vinyl toluene, 1-methyl toluene, and many others, can be included in the polymeric chain. Cross-linking materials, such as allyl-methacrylate, methylolacrylamide and methylolmethacrylamide, are also added to modify the copolymer structure and molecular weight.

The polymerization is catalyzed by persulfates, such as one or more of the alkali persulfates: sodium persulfate, potassium persulfate or ammonium persulfate. As reducing agents, necessary for carrying the polymerization, ferrous sulfate heptahydrate, sodium sulfate, sodium metabisulfate, sodium formaldehyddessulfoxlate dihydrate or tert-butyl hydroperoxide can be used.

In order to stabilize the emulsion, the pH is adjusted throughout the polymerization and in the final formulation by acids, bases and buffers, such as acetic and citric acids, ammonium hydroxide and potassium phosphates.

The polymerization takes place in emulsion, aqueous dispersion and solutions, at a wide range of temperatures including ambient, according to the desired mode of application. The concentration of the UVR attenuator in the dispersion is between 1% and 20% on a weight basis, and preferably, between 5% to 10%.

Various surfactants, anionic and non ionic, serve to stabilize the emulsion before and during the polymerization, including, for instance, sodium lauryl sulfate, sulfated compounds and sulfonated compounds such as polyoxyethylene, nonylphenol sulfate and dodecyl benzene sulfonic acid.

When needed, commercially available antifoams and other rheology modifiers are also added to the formulations in accordance to the desired use of the formulation.

Typically the emulsion or dispersion contains 35 to 55 percent of solids and micelles having the size of 1 to 10 nm, preferably 2 to 5 nm.

Physical UVR attenuators for absorbing, reflecting, diffusing or otherwise blocking ultraviolet radiation, such as ultrafine metal oxides, physically block the apertures in the fabric and finished textile. These attenuators include titanium dioxide and zinc oxide milled such that at least 80% has a long dimension of less than 1000 nm. Preferably, at least 80% has a long dimension of less than 250 nm.

The present invention also makes use of chemical UVR attenuators, in addition to physical UVR attenuators. These include p-amino benzoic acid (PABA) and esters thereof, benzophenones, benzo-triazoles, cinnamates, avobenzones, oxybenzones and other similar functional compounds.

Reference is now made to the following example, which together with the above descriptions, illustrate the invention in a non-limiting fashion.

A benzotriazole type UVR attenuator is pasted, then dissolved in a small amount of alcohol, ketone, ether or ester-based solvent. The UVR attenuator is slowly mixed into an aqueous acrylic copolymer containing anionic and non-ionic surfactants.

Sub-micron size, coated (or non-coated) titanium dioxide in glycol paste is homogenized for 2 to 20 minutes in de-ionized water. The resultant dispersion is immediately mixed into the above-mentioned acrylic copolymer emulsion.

Typical proportions of the formulations are:

| | |
|---|---|
| acrylic copolymer emulsion | 75% |
| solvent | less than 2% |
| one or more chemical attenuators | 0.2–5% |
| titanium dioxide | 1–10% |
| surfactants | 2% |
| water | to 100% |

The above formulation is diluted in water in a weight ratio of up to 1:10 depending on the yarn, fibers or fabric to be treated and on the end use and application equipment. Curing after treatment is performed at various temperatures varying from ambient to 180° C., according to the particular formulation and mode of application.

It will be appreciated that the above descriptions are intended only to serve as an example, and that many other embodiments are possible within the spirit and the scope of the present invention.

Application can be performed by all the common techniques known in the textile industry such as, but not limited to, low pressure padding, soaking, laminating and one or two sided spraying of the fabric in the factory. Some of these formulations can be applied to finished garments and other textiles, in the home of the consumer, using aerosol spraying containers. The aerosol spray coats the textile with a thin, non-selective, universal formulation suitable to substantially almost all fabric types, without a need to adapt different formulations to various fibers.

These formulations have been tested with many types of fabrics, including woven, non-woven and knit fabrics. They are compatible with natural fibers such as cotton, man-made fibers such as polyesters, elastanes, polyamide, polyolefines and viscose, as well as blends thereof. It was also found that the formulations of the present invention are appropriate for elastic fabrics of the spandex type having an elongation of up to 60% in both length and width. The formulations of the present invention are versatile enough to coat low density weave, having gaps of up to 2 mm, or very high-density cloth.

Some of these versatile formulations also contain chemical UVR attenuators, beside the physical attenuators. They have, in the formulation, cross-linking compounds that allow rapid polymerization and curing at ambient temperatures without necessarily use of an oven as usually practiced by the textile industry. The sprayed coating forms a thin transparent or translucent, flexible durable layer of between 100 nm and 100 micrometer on the surface of the textile. Preferably, the layer has a thickness of between 150 nm and 50 micrometer. The treated textile undergoes substantially no change in appearance, color, and feel. Breathability is largely maintained and the coating remains flexible over time.

It has been surprisingly found that the use of mixtures of both chemical and physical UVR attenuators in accordance with the present invention provides a synergistic effect in terms of UVR attenuation. Without wishing to be bound by theory, it is believed that this synergistic effect is due to repeated dispersions and reflections by the physical attenuators that enhance the absorptive activity of the chemical attenuators, thereby achieving a much higher UVR attenuating effect.

Contrary to formulations for the protection of human skin, formulations for UVR attenuation of yarns, fibers, fabrics and finished textiles should form a very thin flexible protecting layer that bonds to the fibers and is aesthetic, breathable, abrasion resistant, long lasting, durable to multiple wash cycles and inexpensive.

It is not obvious that physical and chemical UVR attenuators can function together in such a thin layer and have all these characteristics. Moreover, it is also not obvious why the above-described synergistic effect occurs when the materials of the present invention are applied to yarns, fibers, fabrics and finished textiles.

FIG. 2 demonstrates that fabrics are also protected from the deleterious effects of UV radiation by applying physical UVR attenuators without adding any chemical UVR attenuators, and in addition, the synergistic effect of applying chemical and physical UVR attenuators on fabric, in comparison to fabrics treated by only chemical or physical attenuators. For example, at a wavelength of 340 nm, the % UV transmission for the material containing 0.5% chemical blocker and the material containing 1% chemical blocker are substantially identical —29%. The addition of 1% physical blocker to the material containing 0.5% chemical blocker reduces the %UV transmission to only 18%.

FIG. 3 shows the UV transmission at 310 nm vs. the concentration of chemical and physical UV attenuators in the resin. It is evident from FIG. 3 that in both cases, the UV transmission decreases strongly with increasing concentration of the attenuators until a critical concentration of ~0.5% is reached, above which the % UV transmission begins to level off.

A comparison of FIGS. 2 and 3 clearly demonstrates, once again, the synergistic effect of using chemical as well as physical UVR attenuators. This is particularly evident in the range of 325–365 nm. Marked synergy is also displayed in the range of 230–280 nm.

The above-described figures are of an exemplary nature, in that the reduction in % transmission of a physical blocker, in accordance with the present invention, can be tailored to desired wavelength ranges by modifying the particular particle size distribution of the physical blocker. Similarly, different chemical blockers, or combinations thereof, can be used in order to provide enhanced protection within a desired wavelength range.

The coating and the additives contained in the coating layer of the present invention are very durable as they attach to the fibers by both chemical and mechanical means. This gives the formulation an enhanced laundering stability, with little observed change in the coating over 50 to 100 wash cycles.

As a result of all the above-mentioned qualities, the formulations of the present inventions are suitable to treat yam, fibers, fabrics and clothes, including very heavy fabrics like sofa fabrics, draperies and car upholstery. Using this invention turns the protection of fabrics and textiles from ultraviolet radiation into a simple and inexpensive activity, which can be performed at home as well as in industrial settings.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A material system for protecting yams, fibers, fabrics and finished textiles from deleterious effects of ultraviolet radiation (UVR), the system comprising:

(a) a material including:

(i) at least one physical UVR attenuator, said attenuator having an average particle size below 1000 nanometers;

(ii) at least one chemical UVR attenuator for interacting with UVR by electron excitation, and (iii) at least one flexible, film-forming polymeric binder for bonding said material to a textile surface, wherein said physical UVR attenuator is dispersed within said binder to form an aqueous dispersion.

2. The material system of claim 1, further comprising:

(b) a textile having said textile surface.

3. The material system of claim 1, wherein said physical UVR attenuator has a particle size distribution wherein at least 80% of said particles have a long dimension below 1000 nanometers.

4. The material system of claim 1, wherein said physical UVR attenuator includes titanium dioxide.

5. The material system of claim 1, wherein said physical UVR attenuator includes zinc oxide.

6. The material system of claim 1, wherein said dispersion is a substantially fully dispersed dispersion.

7. The material system of claim 1, wherein said at least one flexible, film-forming polymeric binder includes acrylic resin.

8. The material system of claim 1, wherein said at least one flexible, film-forming polymeric binder includes polyurethane.

9. The material system of claim 1, wherein said physical UVR attenuator has a concentration of between 1% and 20% on a weight basis.

10. The material system of claim 1, wherein said chemical UVR attenuator is dispersed within said binder to form a phase selected from the group consisting of aqueous dispersion and solution, said chemical UVR attenuator having a concentration of between 0.2% and 5% on a weight basis.

11. The material system of claim 1, wherein said chemical UVR attenuator is selected from the group consisting of p-amino benzoic acid (PABA) and esters thereof, benzophenones, benzo-triazoles, cinnamates, avobenzones, and oxybenzones.

12. The material system of claim 2, said material designed and configured to form, upon drying and curing, a flexible layer for intimate attachment to said textile surface.

13. The material system of claim 12, wherein said layer is translucent.

14. The material system of claim 12, wherein said layer is transparent.

15. The material system of claim 12, wherein said layer has an average thickness of less than 100 micrometers.

16. The material system of claim 12, wherein said layer has an average thickness of more than 100 nm.

17. The material system of claim 9, wherein said at least one binder is selected from the group consisting of butyl acrylate, ethyl acrylate, 2-ethyl hexylacrylate and methacrylate homologues, styrene, acrylonitrile, vinyl toluene and 1-methyl toluene.

18. The material system of claim 5, the material further including:

(c) at least one cross-linking material selected from the group consisting of allyl-methacrylate, methylolacrylamide and methylolmethacrylamide.

19. The material system of claim 1, wherein said physical UVR attenuator includes teflon.

20. The material system of claim 1, wherein said chemical UVR attenuator is a UVR-absorbing chromophore.

21. A treated fabric structure comprising:

(a) a material including:

(i) at least one physical UVR attenuator, said attenuator having an average particle size below 1000 nanometers, and (ii) at least one flexible, film-forming polymeric binder for bonding said material to a textile surface, wherein said physical UVR attenuator is dispersed within said binder to form an aqueous dispersion, and (b) a fabric having a plurality of surfaces, said material being intimately attached to at least a portion of said surfaces.

22. The treated fabric structure of claim 21, wherein said material is disposed as a layer on said portion of said surfaces.

23. The treated fabric structure of claim 21, said material further including at least one chemical UVR attenuator dispersed within said binder.

24. The treated fabric structure of claim 21, wherein said physical UVR attenuator includes teflon.

25. A method for protecting yarns, fibers, fabrics and finished textiles from the deleterious effects of ultraviolet radiation, the method comprising the steps of:

(a) providing a formulation including:

(i) at least one physical UVR attenuator, said attenuator having an average particle size below 1000 nanometers, and (ii) at least one flexible, film-forming polymeric binder;

(b) applying said formulation to a fabric surface to produce a layer, and (c) intimately attaching said layer to said fabric surface.

26. The method of claim 25, wherein said layer has a average thickness of less than 100 micrometers.

27. The method of claim 25, wherein said layer has a average thickness of more than 100 nm.

28. The method of claim 25, wherein said layer is flexible and transparent.

29. The method of claim 25, wherein said layer is flexible and translucent.

30. The method of claim 25, wherein said fabric surface includes both natural and synthetic materials.

31. The method of claim 30, wherein said layer is a flexible, attrition-resistant layer having an average thickness of no more than 500 micrometers.

32. The method of claim 25, said formulation further including:

(iii) at least one chemical UVR attenuator for interacting with UVR by electron excitation.

33. The method of claim 25, said formulation further including:

(iii) at least one cross-linking material selected from the group consisting of allyl-methacrylate, methylolacrylamide and methylolmethacrylamide.

34. The method of claim 25, wherein said intimately attaching of said layer to said fabric surface includes polymerization and curing.

35. The method of claim 25, wherein said polymerization and said curing are performed at a temperature below 180° C.

36. The method of claim 25, wherein said polymerization and said curing are performed at an ambient temperature.

37. The method of claim 25, wherein said applying is spraying.

38. The method of claim 37, wherein said spraying is an aerosol spraying performed at an ambient temperature.

39. The method of claim 25, wherein said applying is laminating.

* * * * *